US009975610B2

(12) United States Patent
Geum

(10) Patent No.: US 9,975,610 B2
(45) Date of Patent: May 22, 2018

(54) SMALL LEISURE BOAT PROVIDED WITH TABLE AND SEATS

(71) Applicant: KOREAMYBOAT CO., LTD, Chungcheongbuk-do (KR)

(72) Inventor: Sung Yeol Geum, Chungcheongnam-do (KR)

(73) Assignee: KOREAMYBOAT CO., LTD, Chungcheongbuk-do (KR)

( * ) Notice: Subject to any disclaimer, the term of this patent is extended or adjusted under 35 U.S.C. 154(b) by 0 days. days.

(21) Appl. No.: 14/912,074

(22) PCT Filed: Aug. 12, 2014

(86) PCT No.: PCT/KR2014/007507
§ 371 (c)(1),
(2) Date: Feb. 12, 2016

(87) PCT Pub. No.: WO2015/023118
PCT Pub. Date: Feb. 19, 2015

(65) Prior Publication Data

US 2016/0200403 A1 Jul. 14, 2016

(30) Foreign Application Priority Data

Aug. 13, 2013 (KR) ..... 10-2013-0096168

(51) Int. Cl.
*B63B 35/73* (2006.01)
*B63B 3/08* (2006.01)
(Continued)

(52) U.S. Cl.
CPC ..... *B63B 35/73* (2013.01); *B63B 1/125* (2013.01); *B63B 3/02* (2013.01); *B63B 3/08* (2013.01);
(Continued)

(58) Field of Classification Search
CPC ..... B63B 1/125; B63B 2001/126; B63B 3/02; B63B 3/04; B63B 3/06; B63B 3/08;
(Continued)

(56) References Cited

U.S. PATENT DOCUMENTS 1,296,668 A * 3/1919 Koziol ..... B63B 43/14 114/348
2,991,488 A 7/1961 Le Cron, Sr.
(Continued)

FOREIGN PATENT DOCUMENTS

JP 2000053073 2/2000
KR 10-1203603 B1 11/2012

OTHER PUBLICATIONS

International Search Report and Written Opinion for PCT/KR2014/007507, dated Feb. 25, 2015 (11 pages).

*Primary Examiner* — Ajay Vasudeva
(74) *Attorney, Agent, or Firm* — K&L Gates LLP

(57) ABSTRACT

Disclosed in the present invention is a small leisure boat. The leisure boat according to the present invention comprises: a container-shaped boat on which people board; seats arranged along the inner wall of the boat body; three or more connection rods of which one end is coupled to the boat body and which are arranged symmetrically with the boat body at the center; and floating bodies respectively connected to the other end of each of the connection rods. According to the present invention, riders can converse or play a game while facing each other by arranging the table inside the boat body and the seats around the table, thereby increasing convenience and entertainment aspects of leisure activities. Also, the stability of the leisure boat is significantly increased by the floating bodies arranged symmetrically around the boat body, and the boat body is not easily rocked due to movement of users or waves due to the
(Continued)

positioning of the boat body at the center of the three floating bodies, thereby enabling enjoyment of refreshing and safe leisure activities.

10 Claims, 13 Drawing Sheets

(51) Int. Cl.

| | |
|---|---|
| ***B63B 7/04*** | (2006.01) |
| ***B63B 43/14*** | (2006.01) |
| ***B63B 3/02*** | (2006.01) |
| ***B63B 29/04*** | (2006.01) |
| ***B63B 1/12*** | (2006.01) |
| ***B63B 7/02*** | (2006.01) |
| ***B63B 17/02*** | (2006.01) |

(52) U.S. Cl.
CPC ..... *B63B 7/02* (2013.01); *B63B 7/04* (2013.01); *B63B 17/02* (2013.01); *B63B 29/04* (2013.01); *B63B 43/14* (2013.01); *B63B 2029/043* (2013.01)

(58) Field of Classification Search
CPC ..... B63B 2003/085; B63B 5/24; B63B 2005/242; B63B 2005/245; B63B 2005/247; B63B 7/00; B63B 2007/003; B63B 2007/006; B63B 7/02; B63B 7/04; B63B 7/06; B63B 2007/065; B63B 7/08; B63B 7/082; B63B 7/085; B63B 7/087; B63B 9/00; B63B 9/06; B63B 35/73; B63B 43/14; B63B 2043/145
USPC ..... 114/346, 352–354, 357
See application file for complete search history.

(56) References Cited

U.S. PATENT DOCUMENTS

| | | | | |
|---|---|---|---|---|
| 3,212,109 | A * | 10/1965 | Roman | B63B 1/125 114/352 |
| 3,382,513 | A * | 5/1968 | Jennings | B63B 1/041 114/219 |
| 9,284,020 | B2 * | 3/2016 | Lee | B63B 7/00 |
| 2006/0162637 | A1 | 7/2006 | Schmitt | |
| 2013/0199431 | A1 | 8/2013 | Nemeth et al. | |

* cited by examiner

SMALL LEISURE BOAT PROVIDED WITH TABLE AND SEATS

CROSS REFERENCE TO RELATED APPLICATION

This application is the United States National Stage of and claims priority to International Application No. PCT/KR2014/007507, which was filed Aug. 12, 2014, that claims priority to Korean Application No. 10-2013-0096168 filed on Aug. 13, 2013, titled "SMALL LEISURE BOAT PROVIDED WITH TABLE AND SEATS", both of which are is incorporated herein by reference in their entirety.

TECHNICAL FIELD

The present invention relates to a small leisure boat, and particularly, to a leisure boat including a table and seats to enable passengers to play various leisure activities on board.

BACKGROUND ART

In recent years, as populations for water leisure such as water play, fishing, water-skiing, skin scuba, or the like have increased, a lot of small leisure boats have been used.

The small leisure boats may be divided into a soft boat made of vinyl, rubber, and the like and a hard boat made of FRP, metal, and the like.

Among them, the soft boat has an advantage in that the soft boat can be easily purchased because a price is comparatively lower, but a disadvantage in that since there are no seats, it is difficult for many people to use the soft boat for a long time and since stability is low, long-term operation of the soft boat is difficult. Further, whenever the soft boat is used, since a cumbersome procedure of injecting and removing air needs to be performed, the small boat has a disadvantage in that it is inconvenient to use the small boat.

Since the hard boat has higher stability and seats as compared with the soft boat, the hard boat has an advantage in that long-terms use and long-term operation are available, but there is a problem in that since the price is high, it is difficult to publicly use the hard boat. Further, the small boat has a problem in that since seats are placed toward the front side, it is difficult for passengers to conveniently talk with one another while facing one another or do various leisure activities such as a game, and the like on board.

In addition, since the conventional small leisure boat relies only on buoyancy of a boat body, shaking is too severe when the passengers move on the boat, therefore, there is a problem in that it is difficult to enjoy the water leisure for a long time with the small boat.

Further, in the case of the soft boat, when an accident such as a puncture occurs, there is a high risk that a casualty will occur and when a crack is caused in the boat body of the hard boat which is relatively safe, due to external shock, there is a problem in that it is difficult to avoid sinking. In order to solve the problems, there is a case in which an air tube is additionally mounted on an outer surface of the boat body, disclosed in Patent Registration No. 10-1224156 (published on Jan. 14, 2013), and there is inconvenience in that air is injected and removed, and manufacturing cost increases due to a complicated structure.

DISCLOSURE

Technical Problem

The present invention is contrived to solve the problems, and an object of the present invention is to provide a small leisure boat having high safety, which is small in shaking in spite of a user's motion or waves, is not easily turned over, and is not sunken even though the boat body is damaged.

Further, an object of the present invention is to provide a small leisure boat of which assembly and use are convenient.

In addition, an object of the present invention is to provide a leisure boat of which convenience and amusement are enhanced so that users talk with one another or play a game while facing one another.

Technical Solution

In order to achieve the aforementioned object, the present invention provides a small leisure boat including: a container-shaped boat body on which people board; seats arranged along the inner wall of the boat body; three or more connecting rods of which one end is coupled to the boat body and which are arranged symmetrically with the boat body at the center; and floating bodies connected to the other end of each of connecting rods, respectively.

In the small leisure boat according to the present invention, the boat body includes a lower body having a container shape with the bottom and the side wall and a seating portion which extends outward along the periphery of the top thereof and an upper body coupled to the top of the lower body, and the seat may be fixed by inserting an outer edge between the seating portion of the lower body and the upper body.

Further, in the small leisure boat according to the present invention, the lower body may include an upper periphery which protrudes upward at the edge of the seating portion, the upper body may include a lower periphery which protrudes downward at the edge of a lower end, the upper body and the lower body may be assembled to each other so that the lower periphery of the upper body is positioned outside the upper periphery of the lower body, and the seat may be fixed while being pressed by a step portion of the upper body positioned inside the lower periphery of the upper body.

In addition, in the small leisure boat according to the present invention, the seat includes a ring-shaped seat plate laid on the seating portion and a supporter which extends downward at the inner edge of the seat plate, and the step portion of the upper body may be laid on the outer edge of the seat plate to fix the seat.

Moreover, the small leisure boat according to the present invention may further include: three or more coupling tubes installed between the seating portion and the seat plate, into which the connecting rods are inserted, respectively; and a circular coupler including a connector connecting three or more coupling tubes.

Besides, the small leisure boat according to the present invention may further include a circular coupler installed between the seating portion and the seat plate, in which the circular coupler may include three or more groove-shaped rod seating portions on which the ends of the connecting rods are laid, a connector connecting the rod seating portions to each other, and a fixture having a curve corresponding to the connecting rod and coupled to the connector so that the curve is positioned on the top of the rod seating portion, and the fixture and the rod seating portion may constitute the coupling tube into which the connecting rod is inserted.

Further, in the small leisure boat according to the present invention, the coupling tube capable of coupling the connecting rods may be installed at the seating portion of the lower body.

In addition, in the small leisure boat according to the present invention, the connecting rod may include an elastic protrusion which protrudes outward, and the coupling tube may include a fastening hole into which the elastic protrusion is inserted.

In addition, a table may be installed at the center of the boat body and a sunshade screen may be installed on the top of the boat body.

Advantageous Effects

According to the present invention, since a table is placed in a boat body and a seat is placed on the periphery of the table to enable passengers to talk with one another or play a game, convenience and amusement of leisure activities can be doubled.

Further, since stability of a leisure boat is significantly increased due to floating bodies symmetrically placed around the boat body and the boat body is positioned at the center of three floating bodies, the leisure boat is not easily shaken even to a user's motion or waves, thereby enabling comfortable and safe leisure activities.

MODES OF THE INVENTION

Figure 1:
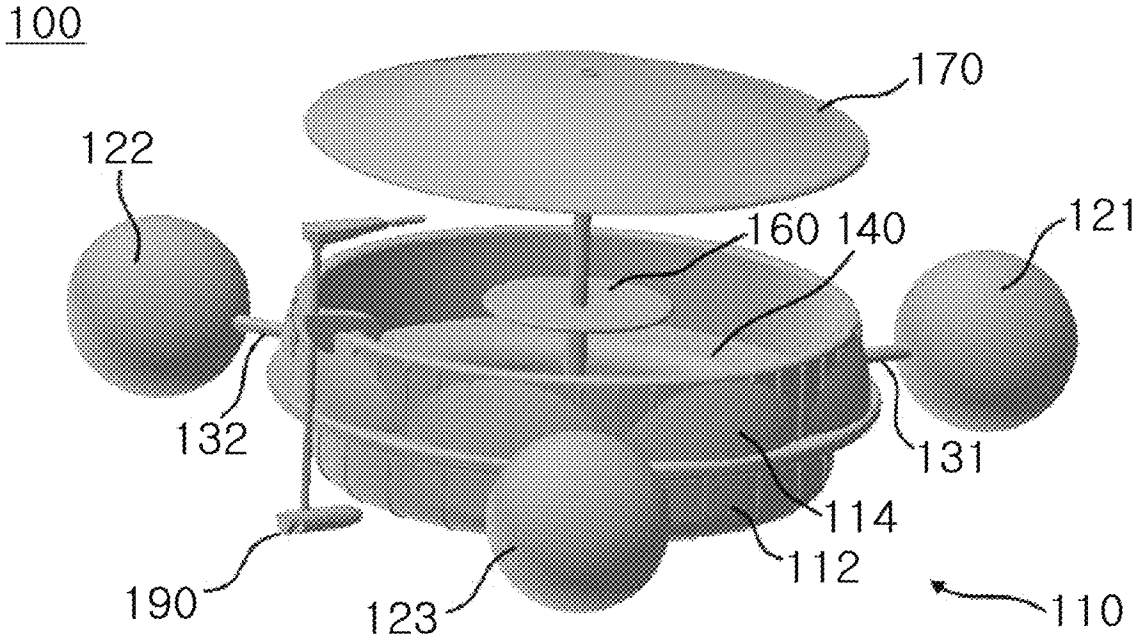
FIG. 1 is a perspective view of a leisure boat according to an embodiment of the present invention.
Figure 2:
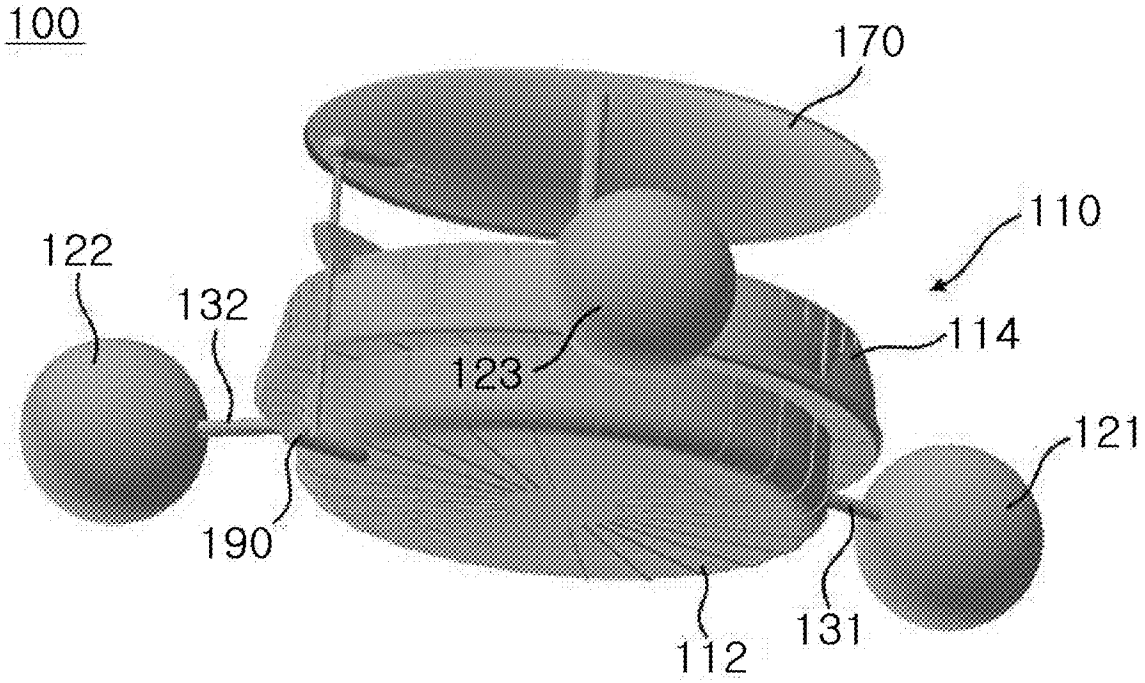
FIG. 2 is a bottom perspective view of a leisure boat according to the embodiment of the present invention.
Figure 3:
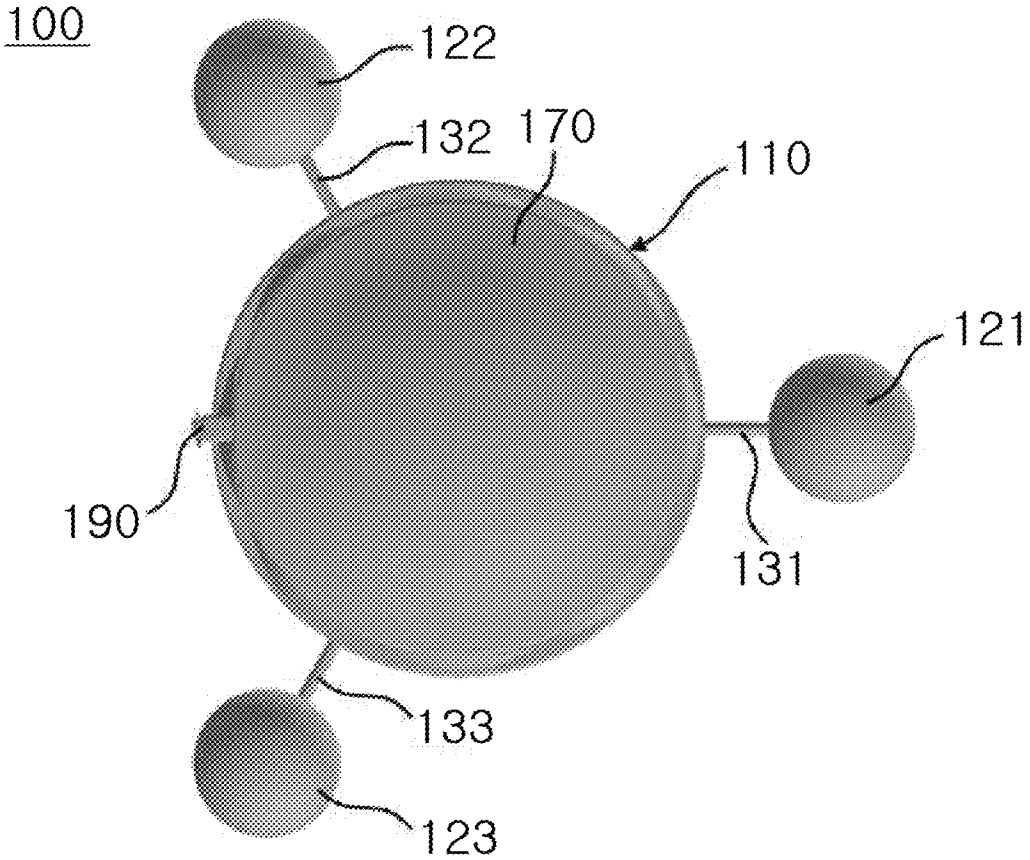
FIG. 3 is a plan view of the leisure boat according to the embodiment of the present invention.

Hereinafter, a preferred embodiment of the present invention will be described in detail with reference to the accompanying drawings.

FIGS. 1 to 5 are a perspective view, a bottom perspective view, a plan view, an exploded perspective view, and an exploded side view of a leisure boat 100 according to an embodiment of the present invention, respectively.

As illustrated in the drawings, the leisure boat 100 according to the embodiment of the present invention includes a cylindrical boat body 110 where persons are on board, three connecting rods 131, 132, and 133 of which one end is coupled to the body 110 and which protrude outward, and three floating bodies 121, 122, and 123 which are coupled to the other end of each of the connecting rods 131, 132, and 133, respectively.

A seat 140 is installed on the inner wall of the boat body 110 in the boat body 110, a table 160 is installed at the center of the boat body 110, and a sunshade screen 170 is installed on the top of the boat body 110.

The leisure boat 100 according to the embodiment of the present invention has an advantage in that since a load of the boat body 110 where persons are on board is distributed to three floating bodies 121, 122, and 123, the leisure boat 100 has still higher safety than the conventional leisure boat which relies only on buoyancy of the boat body 110.

In particular, since each of the floating bodies 121, 122, and 123 shows the buoyancy at a position spaced apart from the boat body 110 by the length of each of the connecting rods 131, 132, and 133, it is advantageous in that the boat body 110 does not easily rock. That is, since the boat body 110 is positioned at the center of each of the floating bodies 121, 122, and 123, the boat body 110 is not significantly shaken even though the passengers stand up or move, and as a result, there is no possibility that the passengers will carelessly fall into water or the boat body 110 will be turned over.

In the embodiment of the present invention, three floating bodies 121, 122, and 123 are placed centering on the boat body 110 at an interval of approximately 120°. However, since the number of floating bodies is not particularly limited to three, four or more floating bodies may be placed centering on the boat body 110 at the same angle.

The boat body 110 of the leisure boat 100 according to the embodiment of the present invention is formed by assembling a lower body 112 and an upper body 114 to be removable.

When the lower body 112 and the upper body 114 are separately manufactured, the shape of each mold used for manufacturing the lower body 112 and the upper body 114 is simplified, thereby significantly decrease manufacturing cost.

Each of the lower body 112 and the upper body 114 is preferably made of a thermoplastic resin material such as Acrylonitrile Butadiene Styrene (ABS), Polypropylene (PP), Polyethylene (PE), or Polycarbonate (PC). When such a material is used, water pollution may be reduced as compared with the convention FRP made hard boat and the manufacturing cost and a process time may be reduced by a method such as vacuum molding.

Figure 6:
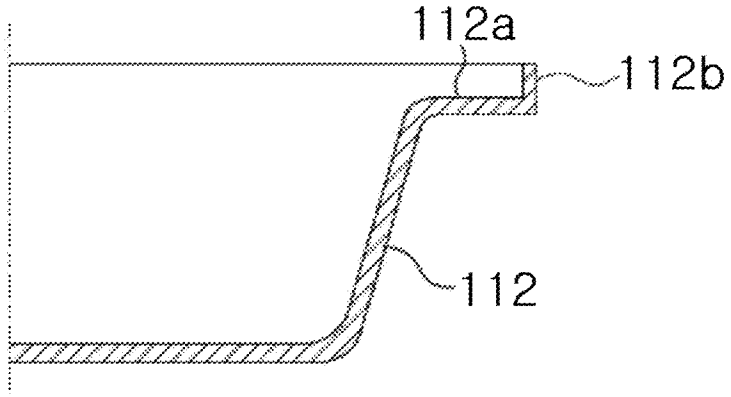
FIG. 6 is a partial cross-sectional view of a lower body.

The lower body 112 serves to generate the buoyancy and provide a boarding space as a cylindrical shape including the bottom and the side wall. In particular, a seating portion 112*a* protrudes on the top of the side wall of the lower body 112 laterally. The seating portion 112*a* is preferably formed in a horizontal direction, but may have a slight inclination. An upper periphery 112*b* protrudes upward on the end of the seating portion 112*a* as illustrated in FIG. 6.

Meanwhile, when the lower body 112 is made of a transparent material, a user may observe the inside of water to double fun.

The upper body 114 is a part that forms the side wall of the boat body 110 together with the side wall of the lower body 112 and has a plane shape like a ring. The bottom of the upper body 114 is held on the edge of the seating portion 112*a* of the lower body 112 in assembly and in particular, a bottom periphery 114*b* which protrudes downward from a lower edge of the upper body 114 is coupled while covering an exterior of the upper periphery 112*b* of the lower body 112.

Figure 4:
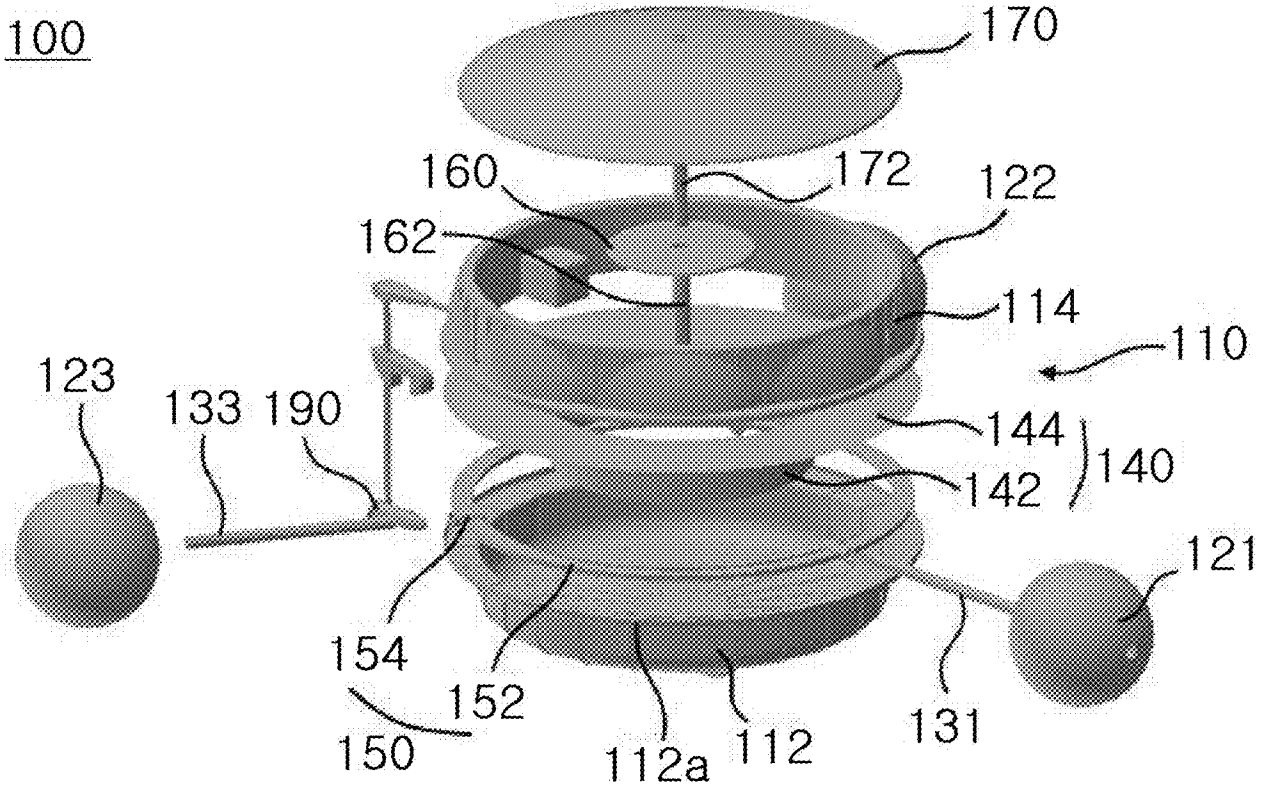
FIG. 4 is an exploded perspective view of the leisure boat according to the embodiment of the present invention.
Figure 5:
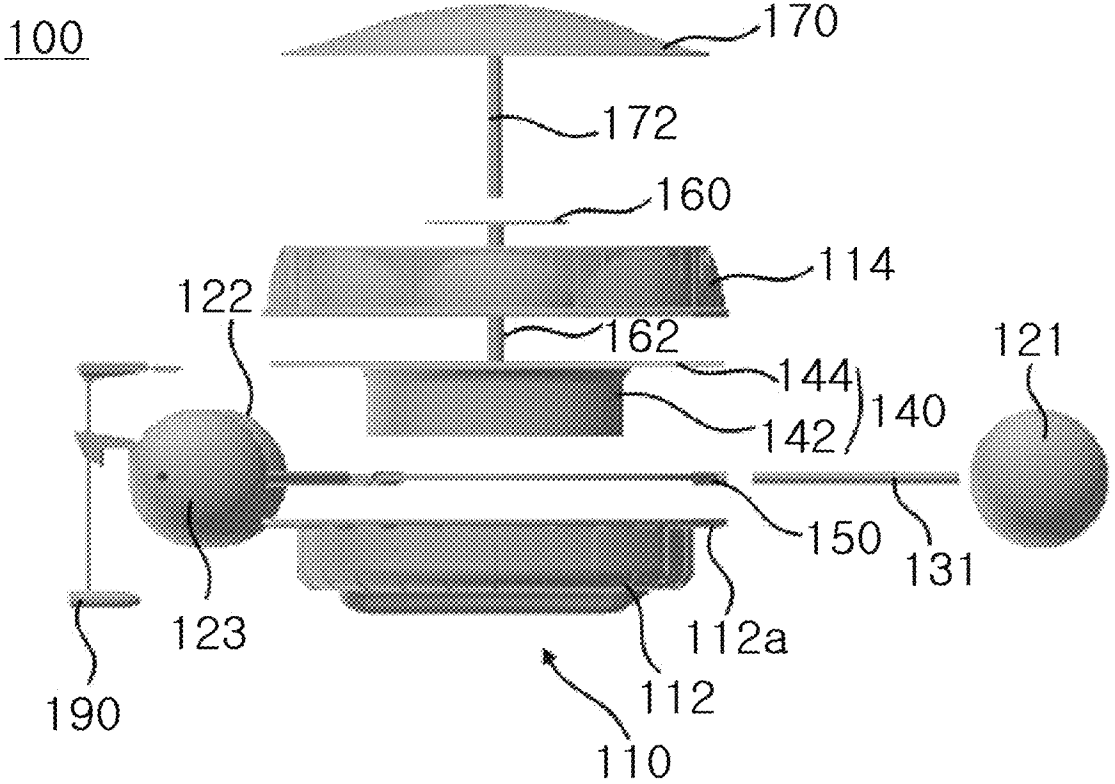
FIG. 5 is a side view illustrating an exploded state of the leisure boat according to the embodiment of the present invention.

The seat 140 includes a ring-shaped seat plate 144 and a supporter 142 that extends downward from an inner edge of the seat plate 144 as illustrated in FIGS. 4 and 5.

The seat plate 144 is a part which is held on the seating portion 112*a* of the lower body 112 and on which the passenger straddles a hip. The supporter 142 preferably has a height as high as the bottom touches the bottom of the lower body 112, but the seat plate 144 is held and fixed on the seating portion 112*a*, and as a result, the seat plate 144 may be spaced apart from the bottom.

In the embodiment of the present invention, a circular coupler 150 is used as a means for coupling each of the connecting rods 131, 132, and 133 to the boat body 110. The circular coupler 150 includes three coupling tubes 154 into which the respective connecting rods 131, 132, and 133 are inserted and a circular connector 152 connecting the respective coupling tubes 154 to each other as illustrated in FIG. 4 and has a ring shape corresponding to the seating portion 112*b* in overall.

The circular coupler 150 is held on the seating portion 112*a* of the lower body 112 and the seat plate 144 of the seat 140 is laid on the top of the circular coupler 150.

Figure 7B:
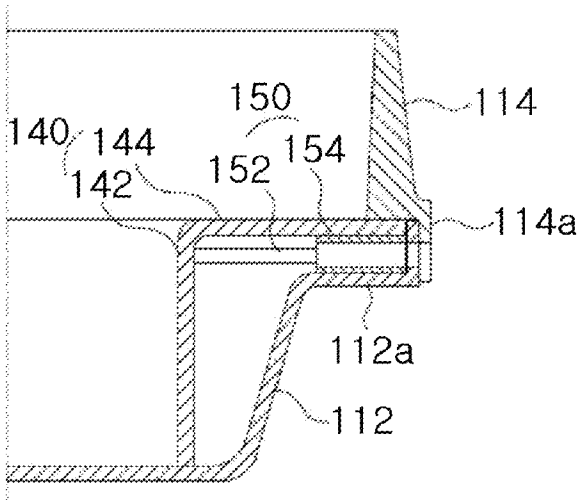
FIGS. 7*a* to 7*c* are cross-sectional views illustrating a method for assembling a boat body of a leisure boat according to an embodiment of the present invention.
Figure 7A:
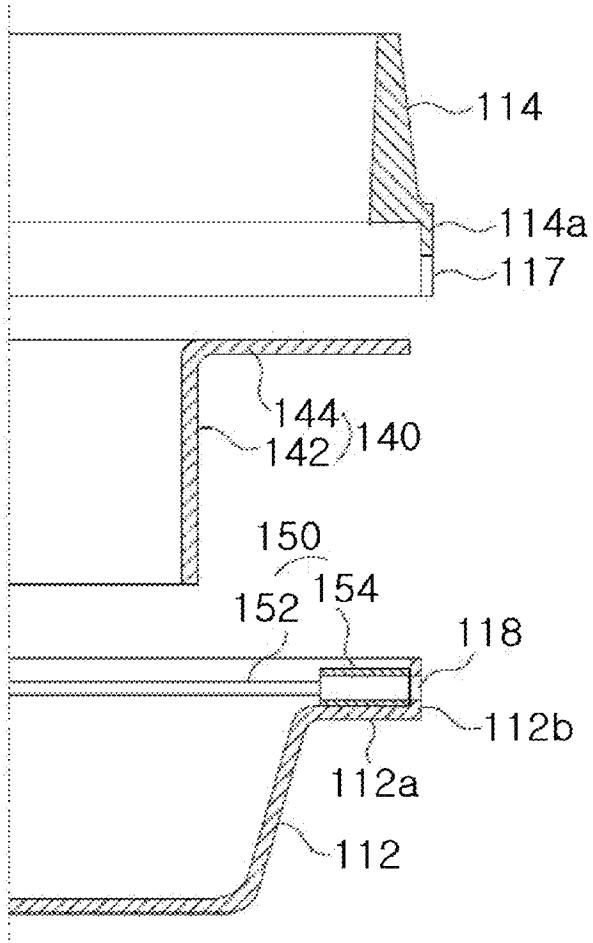

That is, as illustrated in the exploded cross-sectional view of FIG. 7*a* and the assembly cross-sectional view of FIG. 7*b*, the circular coupler 150 and the seat plate 144 are sequentially laid on the seating portion 112*a* of the lower body 112 and the lower body 112 and the upper body 114 are coupled to each other while the upper body 114 is laid thereon.

In this case, since an inlet of the coupling tube 154 of the circular coupler 150 is exposed to the outside of the boat body 110, grooves 117 and 118 need to be formed so that the inlet of the coupling tube 154 is exposed to the upper periphery 112*b* of the lower body 112 corresponding to the coupling tube 154 and the lower periphery 114*b* of the upper body 114. Through-holes may be formed instead of the grooves 117 and 118.

A step portion 114*a* which is higher than the bottom of the lower periphery 114*b* is formed inside the lower periphery 114*b* of the upper body 114. The step portion 114*a* presses an outer periphery of the seat plate 144 from the top to serve to fix the seat 140 and the circular coupler 150.

In such a placement state, when the lower periphery 114*b* of the upper body 114 and the upper periphery 112*b* of the lower body 112 are coupled to each other by a bolt, and the like, the positions of the seat 140 and the circular coupler 150 are fixed without using the bolt, and the like.

Figure 7C:
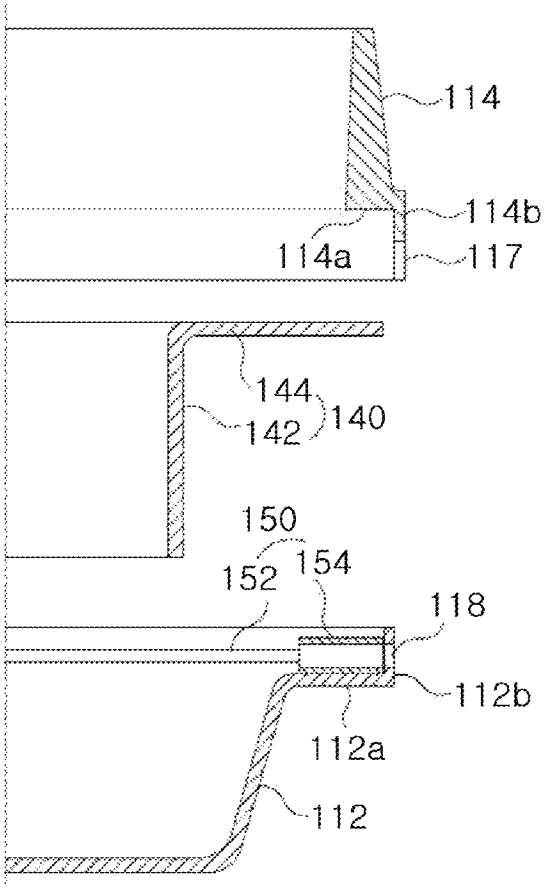

FIG. 7*c* is a diagram illustrating an assembly cross-section of a part where there is no coupling tube 154 in the circular coupler 150. In FIG. 7*c*, it is illustrated as if the circular connector 152 floats in the air without a separate supporting means, but three coupling tubes 154 support the seat plate 144 of the seat 140 at different locations. A separate supporting means may be additionally installed between the seating portion 112*a* of the lower body 112 and the seat plate 144 of the seat 140.

Meanwhile, each of the connecting rods 131, 132, and 133 is inserted and fixed into each coupling tube 154 of the circular coupler 150.

Figure 8A:
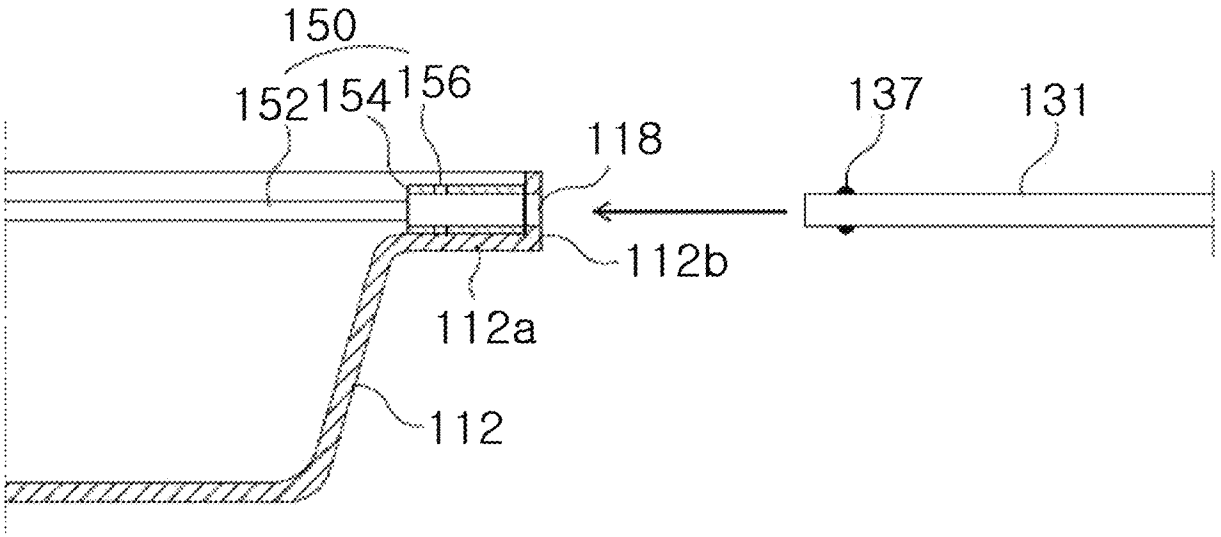
FIGS. 8*a* to 8*c* are diagrams illustrating various methods of mounting connecting rods on the boat body.

In this case, as illustrated FIG. 8*a*, an elastic protrusion 137 having elasticity is installed on one end of the connecting rod 131 and when a fastening hole 156 is formed in the coupling tube 154, the connecting rod 131 may be more conveniently coupled. This is because when the elastic protrusion 137 is inserted into the fastening hole 156, the elastic protrusion 137 is not easily removed.

Figure 8B:
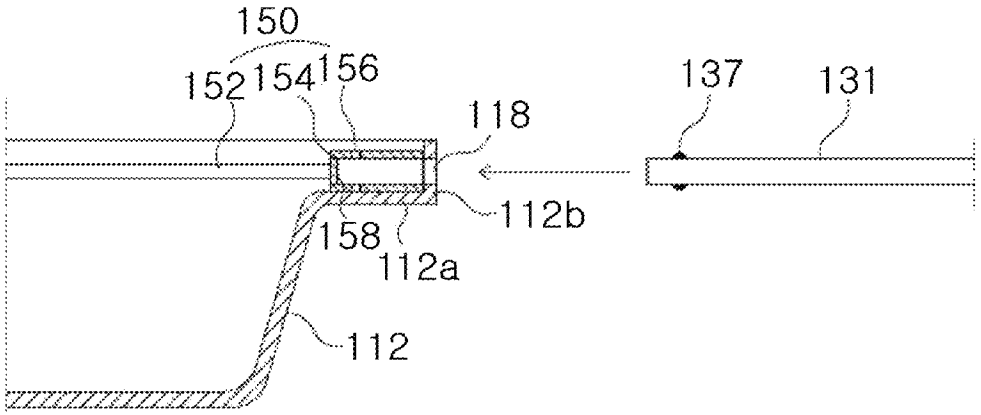

Further, in order to more easily insert the elastic protrusion 137 into the fastening hole 156, a stopper 158 is formed on the end of the coupling pipe 154 as illustrated in FIG. 8*b*. That is, while the connecting rod 131 is pushed into the coupling tube 154 until the connecting rod 131 is caught in the stopper 158, when the elastic protrusion 137 is inserted into the fastening hole 156 by slightly rotating the connecting rod 131, mounting the connecting rod 131 is completed.

The stopper 158 may be formed on the end of the coupling tube 154 and a protrusion having a height to cover a rear end of the coupling tube 154 may be formed in the lower body 112 to implement the stopper 158.

Figure 8C:
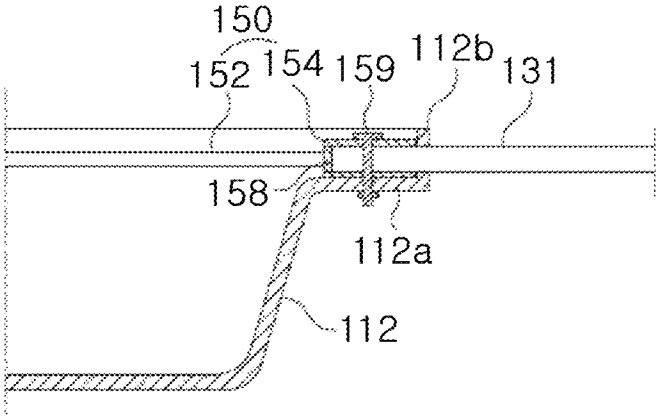

Further, without using the elastic protrusion 137, the connecting rod 131 may be fixed by using a bolt 159 that penetrates the coupling pipe 154, the connecting rod 131, and the lower body 112 as illustrated in FIG. 8*c*. The connecting rod 131 may be fixed by using both the elastic protrusion 137 and the bolt 159.

Figure 9A:
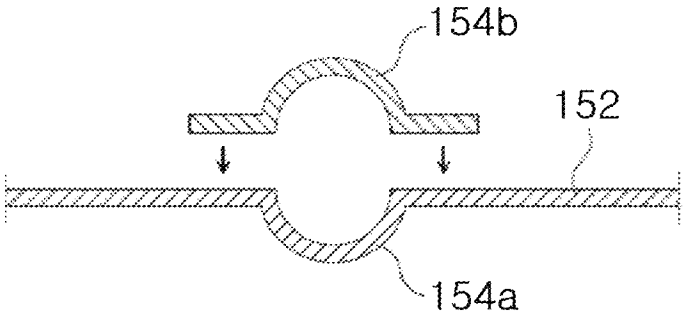
FIGS. 9*a* and 9*b* are diagrams illustrating a modified example of a circular coupler.

Meanwhile, as the coupling tube 154 into which the connecting rod 131 is inserted, an integrated pipe may be used and as illustrated in FIG. 9*a*, the coupling tube 154 may be implemented by coupling a fixture 154*b* capable of covering the connecting rods 131, 132, and 133 to the top of a rod seating portion 154*a* formed in the circular connector 152 to be concave.

Since a structure in which three rod seating portions 154*a* are formed in the circular connector 152 is very simple in molding, the structure is still more easily manufactured than coupling the connector 152 to the pipe type coupling tube 154.

Figure 9B:
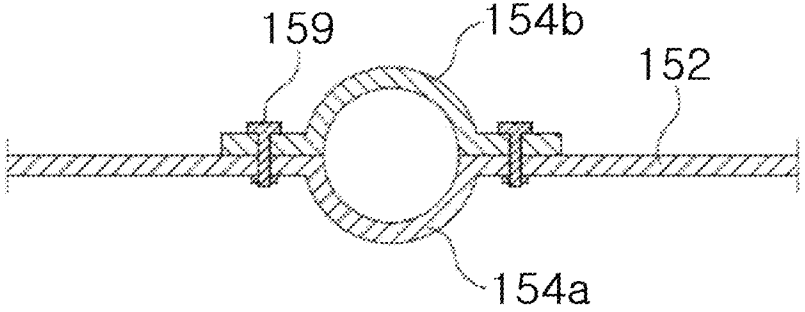

The fixture 154*b* may be made of a plastic material like the connector 152 to be fused to the connector 152 or coupled through the bolt 159 as illustrated in FIG. 9*b*.

As each of the connecting rods 131, 132, and 133, a carbon pipe which is small in weight and excellent in durability is preferably used, but the material thereof is not limited thereto.

The floating bodies 121, 122, and 123 coupled to the respective connecting rods 131, 132, and 133, respectively are preferably made of expandable polypropylene (EPP) which is small in weight and excellent in durability, but the material thereof is not particularly limited thereto.

Figure 10A:
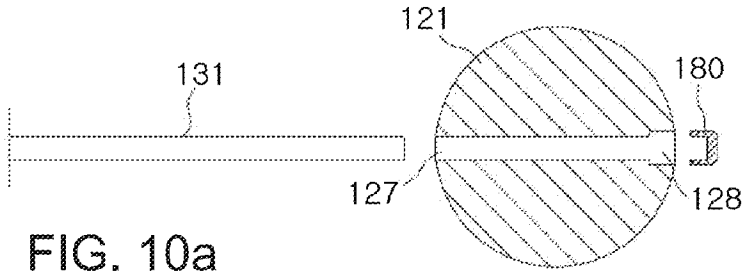
FIGS. 10*a* to 10*c* are diagrams illustrating various methods of coupling floating bodies to connecting rods.
Figure 10B:
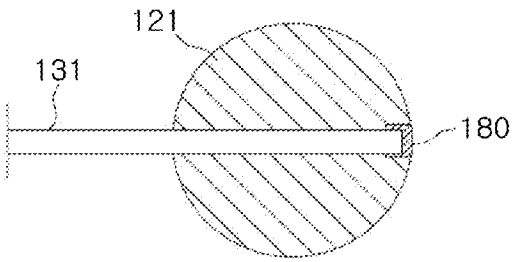

As illustrated in FIGS. 10*a* and 10*b*, each of the floating bodies 121, 122, and 123 includes a through-hole 127 into which each of the connecting rods 131, 132, and 133 is inserted. A fixing cap 180 is preferably coupled to the end of the connecting rods 131, 132, and 133 at an opposite side of the through-hole 127 so as to prevent the floating bodies 121, 122, and 123 from being removed after inserting the connecting rods 131, 132, and 133. Of course, an outer diameter of the fixing cap 180 needs to be larger than that of each connecting rod.

The fixing cap 180 may be coupled to the end of the connecting rods 131, 132, and 133 by using a forced inserting scheme, screw-coupled to the end of the connecting rods 131, 132, and 133, or fixed through the bolt, and the like.

In FIGS. 10*a* and 10*b*, an extension portion 128 is formed, in which the fixing cap 180 is inserted into one end of the through-hole 127 of each of the floating bodies 121, 122, and 123, but the present invention is not limited thereto.

Figure 10C:
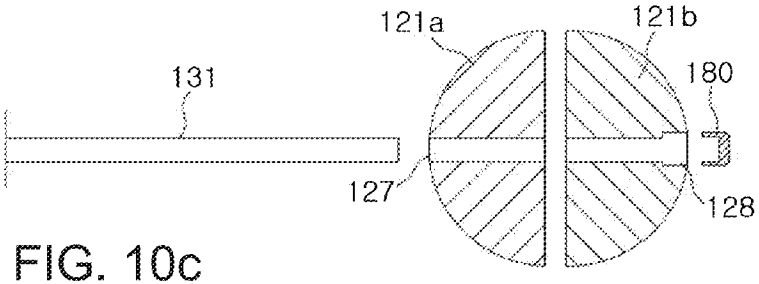

Implementing a spherical floating body by mounting two hemispheres on the connecting rods 131, 132, and 133 as illustrated in FIG. 10*c* is more preferable than manufacturing the floating bodies 121, 122, and 123 by an integrated sphere. The reason is that the hemisphere is easily kept and transported.

Further, since the floating bodies 121, 122, and 123 are not limited to a globular shape, the floating bodies 121, 122, and 123 may be manufactured in various shapes. Accessories having various character shapes which may double amusement may be attached to each of the floating bodies 121, 122, and 123. Further, by considering that each of the floating bodies 121, 122, and 123 is distant from the boat body 110 by a significant distance, a rescue handle which a person who falls into water may easily grasp may be mounted on each of the floating bodies 121, 122, and 123.

Meanwhile, the table 160 is fixed onto the bottom of the lower body 112. In the embodiment of the present invention, a pole 162 is fixed onto the bottom of the lower body 112 and a circular table 160 is mounted on the top of the pole 162. Since a fixing method of the pole 162 is not particularly limited, all coupling methods are available unless an immersion phenomenon occurs in the lower body 112. For example, the table 160 may be installed in such a manner that a coupling protrusion is formed at the center of the bottom of the lower body 112 and the coupling protrusion is inserted into the bottom of the pole 162 at the time of molding the lower body 112. A separate coupling member may be fused or coupled to the bottom of the lower body 112.

The sunshade screen 170 may be installed by inserting the pole 172 into a hole formed at the center of the table 160. Since an installation method of the sunshade screen 170 is not limited thereto, the sunshade screen 170 may be fixed to the upper body 114. Since a material of the sunshade screen 170 is not also particularly limited, the sunshade screen 170 may be made of a stiff material such as a plastic or a in a parasol form.

In the leisure boat 100 according to the embodiment of the present invention, since structures of the lower body 112 and the upper body 114, the seat 140, the circular coupler 150, and the like which constitute the boat body 110 are simple, manufacturing cost may be reduced by decreasing molding cost of the respective components and since vacuum molding is available, mass production is enabled. Consequently, the leisure boat 100 is publicly supplied by lowering a price of the leisure boat to significantly contribute to base expansion of water leisure populations.

The preferred embodiment of the present invention has been described above, but the present invention is not limited to the aforementioned embodiment and transformation, modification, or substitution to various forms may be made.

For example, in the aforementioned embodiment, each of three connecting rods 131, 132, and 133 is inserted and coupled into the coupling tube 154 of the circular coupler 150, but the present invention is not limited thereto.

For example, the circular coupler 150 is omitted and each of the connecting rods 131, 132, and 133 may be fixed to the seating portion 112*a* of the lower body 112 through the bolt, and the like. Further, the pipe type coupling tube 154 may be coupled to the seating portion 112*a* of the lower body 112 and each of the connecting rods 131, 132, and 133 may be inserted and fixed into the coupling tube 154.

In addition, when the lower body 112 and the upper body 114 are very rigidly assembled through the bolt, and the like, each of the connecting rods 131, 132, and 133 may be coupled to the upper body 114.

Moreover, three connecting rods 131, 132, and 133 are installed in the horizontal direction in the drawings, three connecting rods 131, 132, and 133 may be installed to be inclined so that the boat body (110) side is high and each of the floating bodies 121, 122, and 123 is low.

Besides, since the shape of the boat body 110 is not limited to a circular cylindrical shape as illustrated in the drawings, the boat body 110 may be manufactured in various plane shapes including a triangle, a quadrangle, a pentagon, a hexagon, an octagon, and the like.

Figure 11:
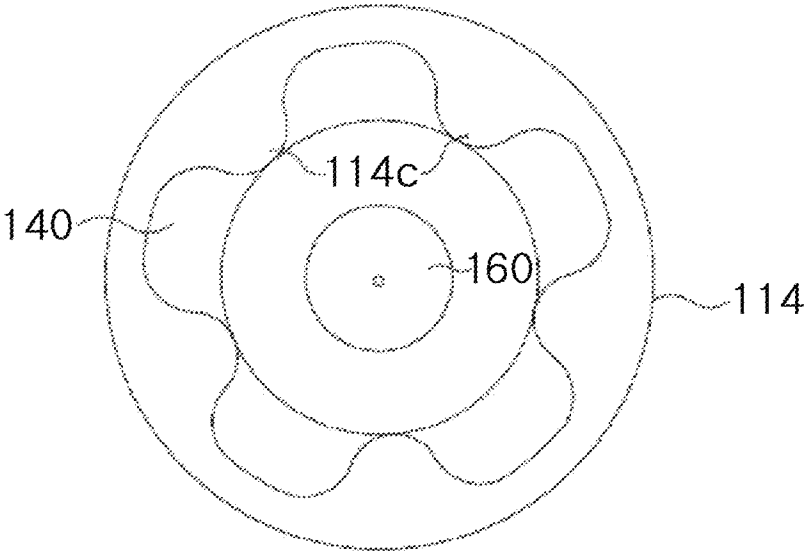
FIG. 11 is a diagram illustrating a shape in which a seat is partitioned by a protrusion of an upper body.

Further, the seat 140 may be integrally placed along the inner wall of the boat body 110 and multiple seats may be separately installed. Further, as illustrated in FIG. 11, multiple inward protrusions 114*c* are formed in the upper body 114 to partition the integral seat 140 so that one passenger seats each seat 140.

In addition, in the leisure boat 100 according to the embodiment of the present invention, a motor propellant 190 is preferably used as illustrated in FIG. 1 for movement. However, since the present invention is not limited thereto, a paddle, a sail, or the like may be used.

In addition, a battery is preferably used as power, but a solar-cell panel is installed in the boat body 110, the sunshade screen 170, and the like to obtain the power. Further, an engine using oil may be mounted to drive a propeller.

Moreover, a light emitting means such as an LED may be installed so as to verify the position of the boat even at night. In addition, a GPS, a satellite communication facility, and the like for verifying the position of the boat and communication may be installed.

Transformation, modification, or substitution to various forms can be made as described above and even when the transformation, modification, or substitution is made, the transformation, modification, or substitution is, of course, included in the scope of the present invention if the transformation, modification, or substitution includes the technical spirit of the present invention disclosed in the claims to be described below.

EXPLANATION OF REFERENCE NUMERALS AND SYMBOLS

100: Leisure boat
110: Boat body
112: Lower body
112*a*: Seating portion
112*b*: Upper periphery
114: Upper body
114*a*: Step portion
114*b*: Lower periphery
117, 118: Groove
121,122,123: First, second, and third floating bodies
127: Through-hole
128: Extension portion
131,132,133: First, second, and third connecting rods
137: Elastic protrusion
140: Seat
142: Supporter
144: Seat plate
150: Circular coupler
152: Connector
154: Coupling tube
156: Fastening hole
158: Stopper
160: Table
170: Sunshade screen
180: Fixing cap
190: Motor propellant

The invention claimed is:

1. A small leisure boat comprising:

a container-shaped boat body on which people board;

a seat arranged along an inner wall of the boat body;

three connecting rods of which one end is coupled to the boat body and which are arranged symmetrically with the boat body at the center; and floating bodies connected to the other end of each of the three connecting rods, respectively;

wherein:

the boat body includes a lower body having a container shape with a bottom and a side wall and a seating portion which extends outward along a periphery of a top of the side wall, and an upper body coupled to a top of the lower body, and the seat is fixed by inserting an outer edge of the seat between the seating portion of the lower body and the upper body.

2. The small leisure boat of claim 1, wherein:

the lower body includes an upper periphery which protrudes upward at an edge of the seating portion, the upper body includes a lower periphery which protrudes downward at an edge of a lower end, the upper body and the lower body are assembled to each other so that the lower periphery of the upper body is positioned outside the upper periphery of the lower body, and the seat is fixed while being pressed by a step portion of the upper body positioned inside the lower periphery of the upper body.

3. The small leisure boat of claim 2, wherein:

the seat includes a ring-shaped seat plate laid on the seating portion and a supporter which extends downward at an inner edge of the seat plate, and the step portion of the upper body is laid on the outer edge of the seat plate to fix the seat.

4. The small leisure boat of claim 3, further comprising:

three coupling tubes installed between the seating portion and the seat plate, into which the three connecting rods are inserted, respectively; and a circular coupler including a connector connecting the three coupling tubes.

5. The small leisure boat of claim 4, wherein each of the three coupling tubes is capable of coupling to each of the three connecting rods installed at the seating portion of the lower body.

6. The small leisure boat of claim 4, wherein:

each of the three connecting rods includes an elastic protrusion which protrudes outward, and each of the three coupling tubes includes a fastening hole into which each elastic protrusion is inserted, respectively.

7. The small leisure boat of claim 3, further comprising:

a circular coupler installed between the seating portion and the seat plate, wherein the circular coupler includes three groove-shaped rod seating portions on which the ends of the three connecting rods are laid;

a connector connecting the three rod seating portions to each other; and a fixture having a curve corresponding to a connecting rod of the three connecting rods and coupled to the connector so that the curve is positioned on a top of a rod seating portion of the three rod seating portions; and the fixture and the rod seating portion constitute a coupling tube into which the connecting rod is inserted.

8. The small leisure boat of claim 7, further comprising three coupling tubes, wherein the three coupling tubes are installed between the seating portion and the ring-shaped seat plate, into which the corresponding three connecting rods are inserted, respectively;

wherein each of the three connecting rods includes an elastic protrusion which protrudes outward, and wherein each of the three coupling tubes includes a fastening hole into which each elastic protrusion is inserted, respectively.

9. The small leisure boat of claim 2, further comprising three coupling tubes, wherein the seat includes a ring-shaped seat plate laid on the seating portion and a supporter which extends downward at an inner edge of the seat plate; and wherein the three coupling tubes are installed between the seating portion and the ring-shaped seat plate, into which the three connecting rods are inserted, respectively;

wherein each of the three connecting rods includes an elastic protrusion which protrudes outward, and wherein each of the three coupling tubes includes a fastening hole into which each elastic protrusion is inserted, respectively.

10. The small leisure boat of claim 1, wherein a table is installed at the center of the boat body and a sunshade screen is installed on a top of the boat body.

* * * * *